US005680658A

United States Patent [19]

Ho

[11] Patent Number: 5,680,658

[45] Date of Patent: Oct. 28, 1997

[54] URINAL FLUSHING CONTROL DEVICE

[75] Inventor: Hsi-Yin Ho, Taipei, Taiwan

[73] Assignee: Liu Chang International Co., Ltd., Taipei Hsien, Taiwan

[21] Appl. No.: 769,486

[22] Filed: Dec. 18, 1996

[51] Int. Cl.[6] ..... E03D 9/02; E03D 13/00

[52] U.S. Cl. ..... 4/301; 4/304; 4/222; 4/309; 261/DIG. 75; 261/64.4

[58] Field of Search ..... 4/301, 302, 303, 4/304, 305, 309, 222, 223, 224, 225.1, 226.1; 261/DIG. 75, DIG. 43, 64.4; 422/292

[56] References Cited

U.S. PATENT DOCUMENTS

| | | | |
|---|---|---|---|
| 5,032,292 | 7/1991 | Conrad | 4/541.1 |
| 5,251,340 | 10/1993 | Su-Land | 4/304 |
| 5,269,028 | 12/1993 | Liao | 4/302 |
| 5,611,088 | 3/1997 | Almon | 4/222 |

FOREIGN PATENT DOCUMENTS

| | | | |
|---|---|---|---|
| 1-029531 | 7/1987 | Japan | 4/222 |
| 3-060667 | 3/1991 | Japan | 4/222 |
| 4-174143 | 6/1992 | Japan | 4/302 |

*Primary Examiner*—David J. Walczak
*Assistant Examiner*—Charles R. Eloshway
*Attorney, Agent, or Firm*—Varndell Legal Group

[57] ABSTRACT

A urinal flushing control device, including a three-way pipe having a first end connected to a water intake pipe, a second end connected to a water outlet pipe through a mixing cylinder, and a third end in the middle mounted with a spring-supported ball valve and connected to an ozonizer. The spring-supported ball valve is drawn inwards by a vacuum suction force when water is discharged from the water intake pipe to the water outlet pipe, to open the passage between the third end of the three-way pipe and the ozonizer, permitting ozone to flow from the ozonizer into the three-way pipe for mixing with water passing therethrough.

1 Claim, 4 Drawing Sheets

URINAL FLUSHING CONTROL DEVICE

BACKGROUND AND SUMMARY OF THE INVENTION

The present invention relates to a urinal flushing control device, and more particularly to such a urinal flushing control device which automatically discharges ozone into a water discharging pipe system for mixing with discharging water.

Regular urinal flushing control devices are commonly controlled to discharge water by a photoelectric sensor through an electromagnetic valve. These urinal flushing control devices only control the discharge of water. There is also known a urinal flushing control device which discharges ozone when induced to discharge water into the urinal.

It is one object of the present invention to provide a urinal flushing control device which discharges ozone into discharging water when induced to discharge water into the urinal. It is another object of the present invention to provide a urinal flushing control device which automatically mixes ozone with discharging water when ozone and water are discharged through a water outlet pipe into the urinal. According to one aspect of the present invention, the urinal flushing control device comprises a three-way pipe having a first end connected to a water intake pipe, a second end connected to a water outlet pipe, which is connected to the discharging pipe of the urinal, and a third end in the middle mounted with a spring-supported ball valve and connected to an ozonizer. The spring-supported ball valve is drawn inwards by a vacuum suction force when water is discharged from the water intake pipe to the water outlet pipe, to open the passage between the third end of the three-way pipe and the ozonizer, permitting ozone to flow from the ozonizer into the three-way pipe for mixing with water passing through. According to another aspect of the present invention, a mixing cylinder is connected between the three-way pipe and the water outlet pipe, having a spiral mixing blade turning on the inside to mix water and ozone.

DETAILED DESCRIPTION OF THE PREFERRED EMBODIMENT

Figure 1:
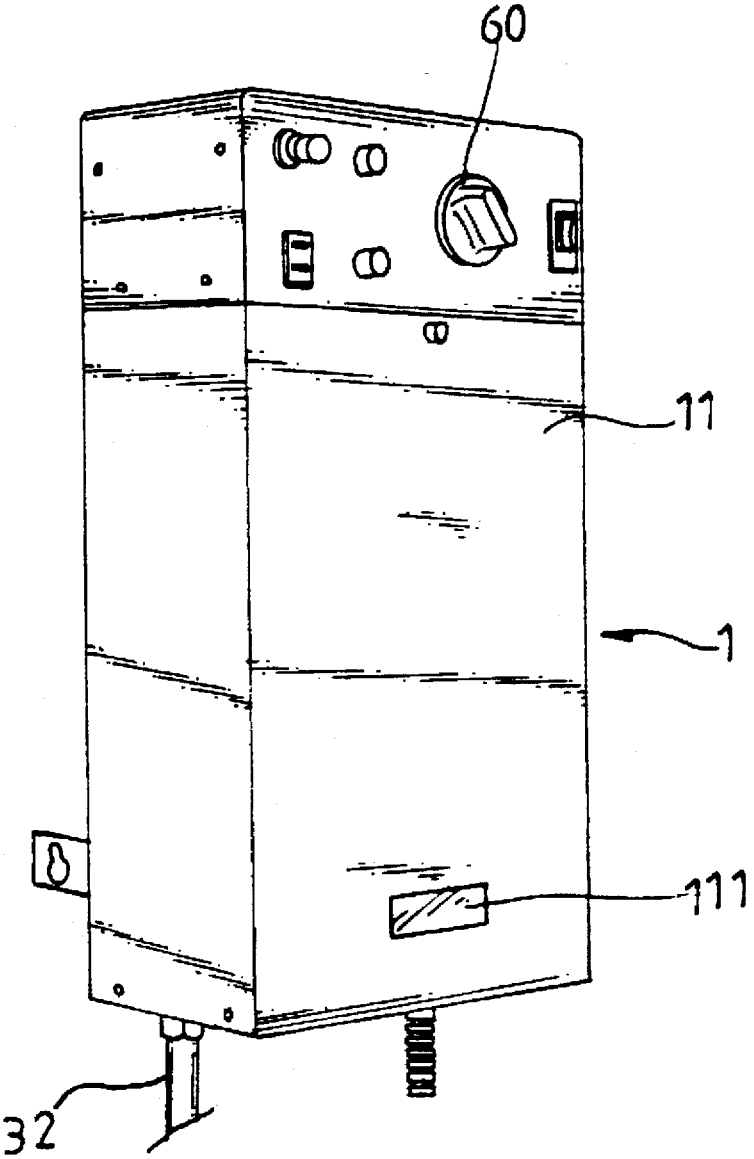
FIG. 1 is an elevational view of a urinal flushing control device according to the present invention.

Referring to FIGS. from 1 to 4, a urinal flushing control device in accordance with the present invention, is generally comprised of a casing 1, a water intake pipe 31, a water outlet pipe 32, a connector 41, an electromagnetic valve 42, an ozonizer 5, and a photoelectric sensor 6, and a timer 60.

The casing 1 is covered with a front cover 11. The front cover 11 has a light penetrating portion, for example, a glass window 111. The water intake pipe 31 is fixedly mounted inside the casing 1, having a bottom end connected to a water supply source, and a top end connected to one end, namely, the top end 412 of the connector 41 through a connecting pipe 220. The connector 41 is mounted inside the casing 1, having a top end 412 connected to the water intake pipe 31 through the connecting pipe 220, and a bottom end 411 connected to the water outlet pipe 32. The electromagnetic valve 42 is connected to the connector 41, and controlled to close/open the passage between the bottom end 411 of the connector 41 and the water outlet pipe 32. The ozonizer 5 is mounted in the casing 1 at the top side, comprised of an ozone generating device 51, a high voltage generator 52, and an air pump 53. The air pump 53 is controlled to pump air into the ozone generating device 51. The high voltage generator 52 discharges a high voltage to ozone generating device 51, causing oxygen to be converted into ozone. The ozone generating device 51 has an output end 511 conneted to an ozone supply pipe 510. The photoelectric sensor 6 is mounted inside the casing 1 behind the glass window 111. When the photoelectric sensor 6 detects the presence of a person, it immediately turns on the electromagnetic valve 42 for a predetermined length of time (about 1–3 seconds), permitting water to be discharged from the connector 41 out of the casing 1 through the water outlet pipe 32 for a predetermined length of time, and then turns off the electromagnetic valve 42 when the predetermined length of time is up. When the person moves out of the detecting range of the photoelectric sensor 6, the photoelectric sensor 6 turns on the electromagnetic valve 42 again for another predetermined length of time (about 8 seconds), and then turns it off. The timer 60 is set to control the discharge of ozone from the ozonizer 5.

Referring to FIGS. from 1 to 4 again, the bottom end 411 of the connector 41 is connected to the water outlet pipe 32 through a three-way pipe 7 and a mixing cylinder 8. The three-way pipe 7 comprises a first pipe section 71, a second pipe section 72 longitudinally connected to the first pipe section 71, and a third pipe section 73 perpendicularly extended from the connecting area between the first pipe section 71 and the second pipe section 72. The first pipe section 71 defines a tapered water passage 711 gradually reducing toward the second pipe section 72. The second pipe section 72 defines a tapered water passage 721 gradually increasing from the first pipe section 71 toward the outside. The third pipe section 73 defines a longitudinal air passage 731, and a jet 732 at one end of the longitudinal air passage 731 in communication with the tapered water passages 711, 721. A spring 74, a ball valve 75 and a gasket ring 76 are respectively mounnted in the longitudinal air passage 731 of the third pipe section 73. The ball valve 75 is supported between the spring 74 and the gasket ring 76. A pipe connector 733 is connected to the third pipe section 73, having an outer end 734 connected to the aforesaid ozone supply pipe 510. Normally, the ball valve 75 is forced by the spring 74 to stop the center hole 761 of the gasket ring 76. Therefore, water is stopped from flowing out of the three-way pipe 7 to the ozone supply pipe 510. The three-way pipe 7 and the mixing cylinder 8 are mounted in a shell 10 inside the casing 1. The third pipe section 73 of the three-way pipe 7 extends out of a hole 101 in the shell 10, and connected to the ozone supply pipe 510 through the pipe connector 733. The bottom end 722 of the second pipe section 72 is connected to the mixing cylinder 8. The mixing cylinder 8 has a top end 81 connected to the bottom end 722 of the second pipe section 72, and a bottom end 82 connected to the water outlet pipe 32 by a pipe connector 820. A spiral mixing blade 80 is mounted inside the mixing cylinder 8.

Figure 2:
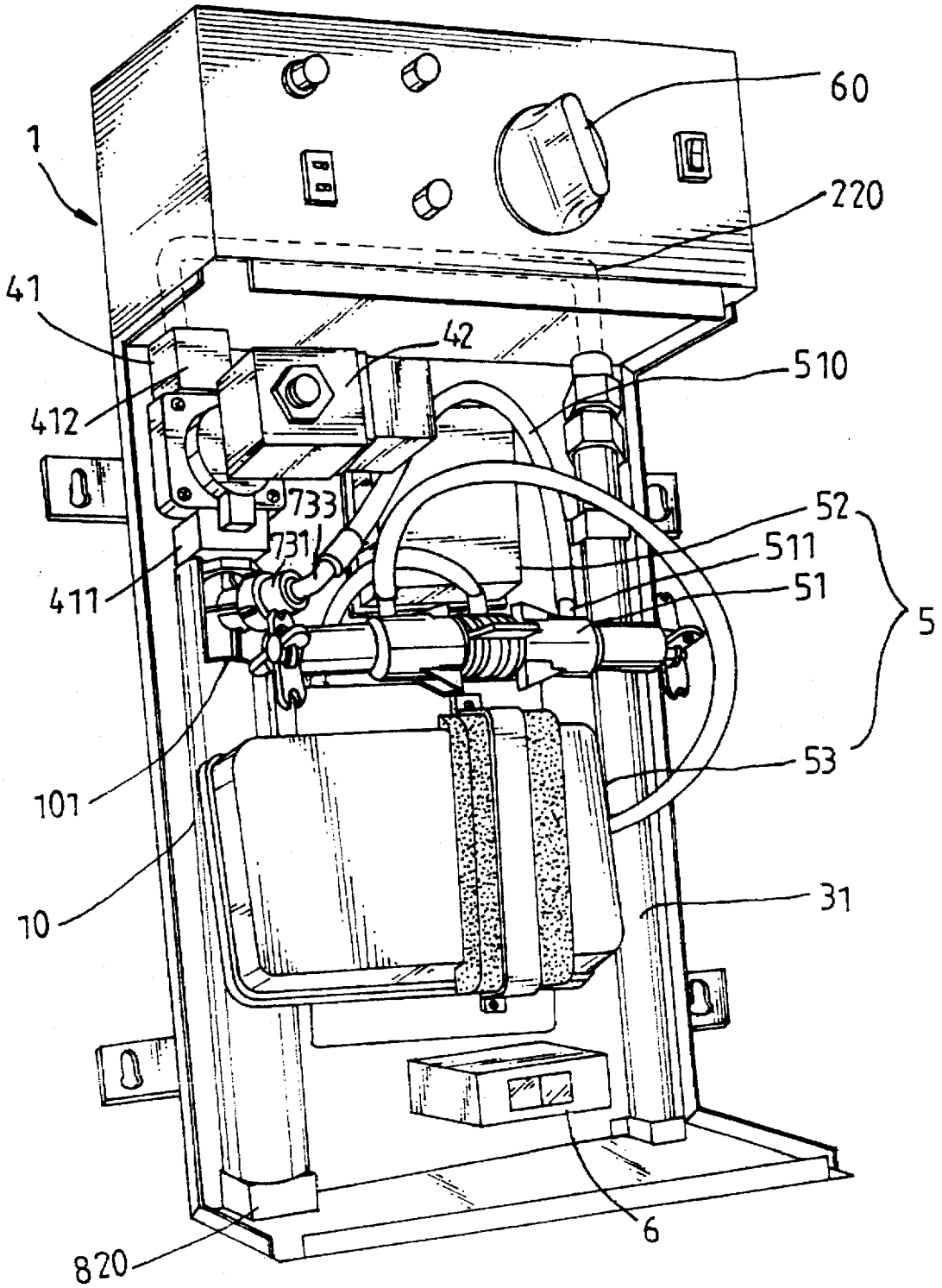
FIG. 2 is perspective view of the present invention, showing the internal arrangement of the urinal flushing control device.
Figure 3:
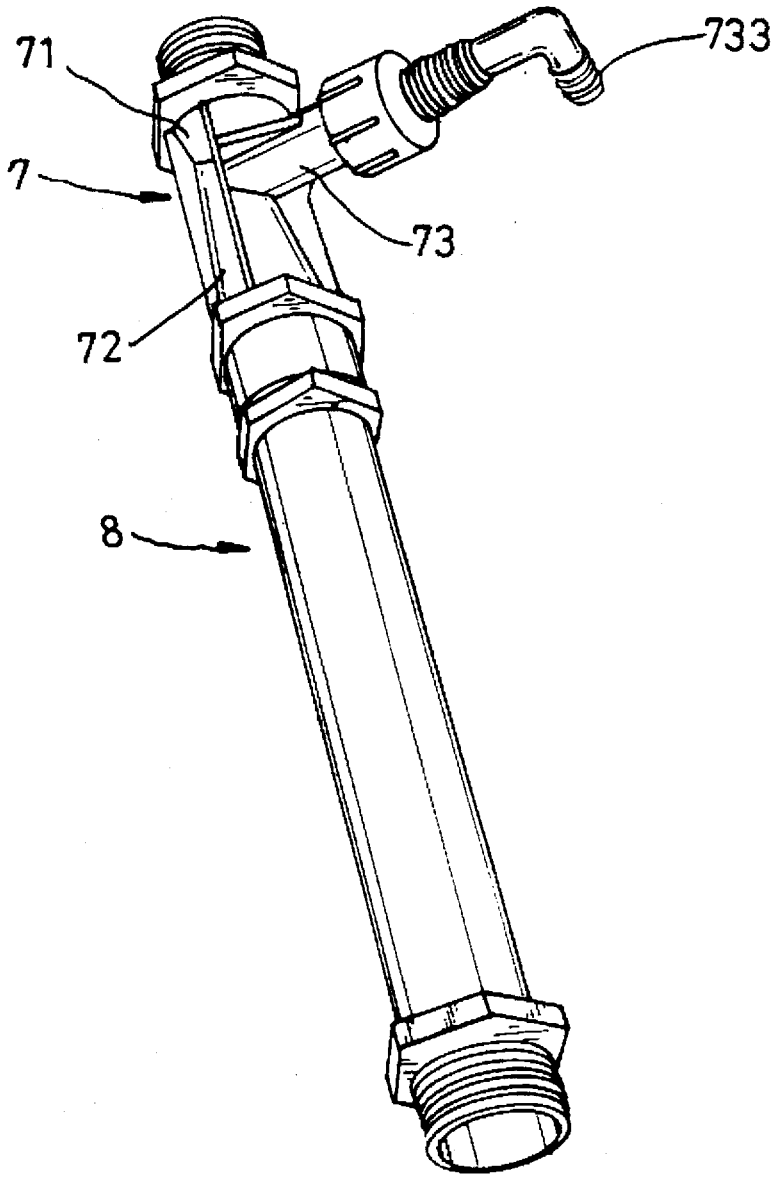
FIG. 3 is an elevational view of a part of the present invention, showing the mixing cylinder connected to the three-way pipe.
Figure 4:
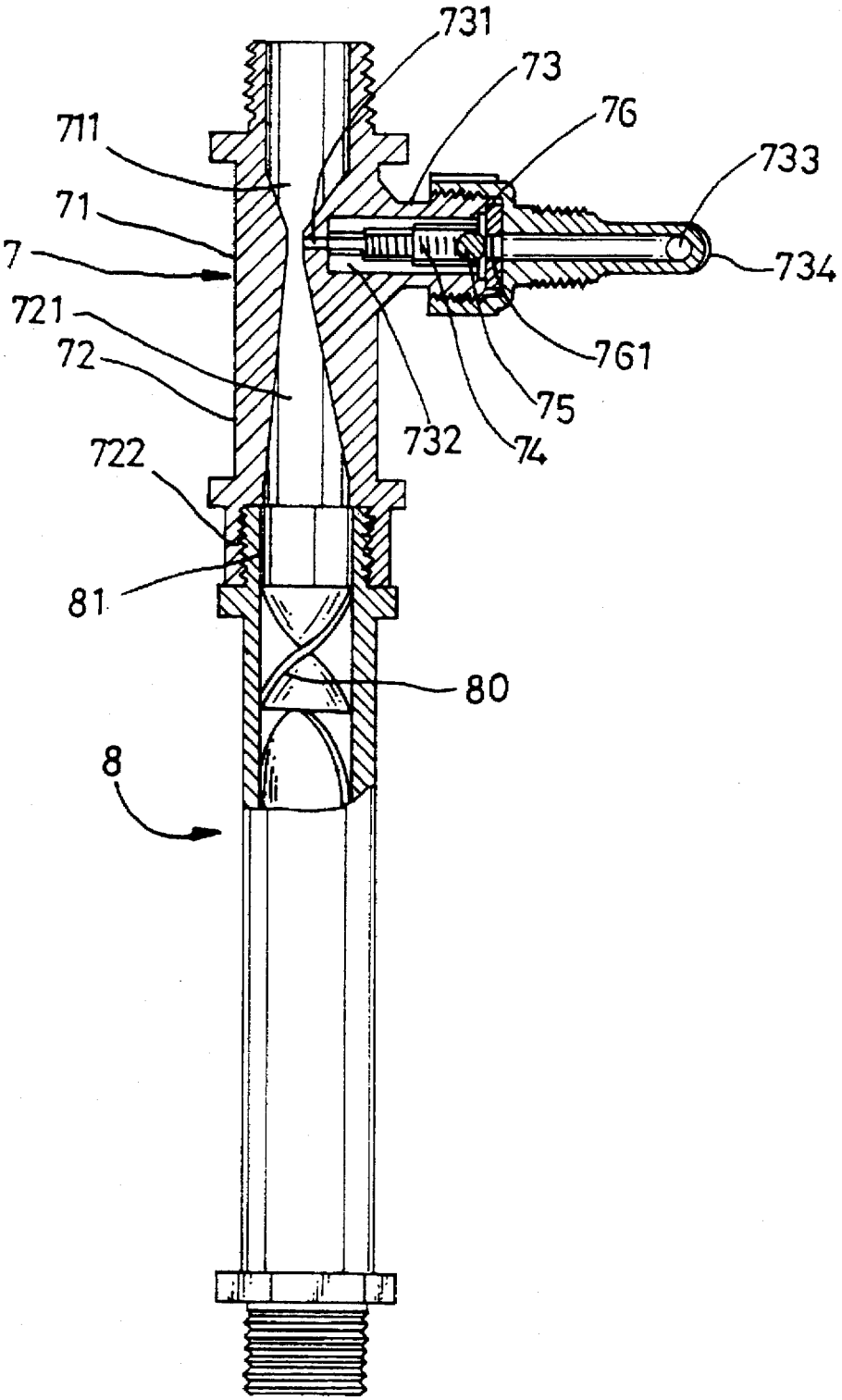
FIG. 4 is a sectional view of the assembly of FIG. 3.

Referring to FIGS. 2 and 3 again, when the electromagnetic valve 42 is opened, water is allowed to pass from the connector 41 through the tapered water passage 711 of the first pipe section 71 and the tapered water passage 721 of the second pipe section 72, to the water outlet pipe 32 via the mixing cylinder 8. When water passes through the neck area between the tapered water passage 711 of the first pipe section 71 and the tapered water passage 721 of the second pipe section 72, the downward flowing speed of water is accelerated, and a sideways vacuum suction force is produced, thereby causing the ball valve 75 to be drawn away from the center hole 761 of the gasket ring 76, for permitting ozone to pass from ozone supply pipe 510 into the three-way pipe 7 and to mix with water. The water and ozone mixture immediately flows downwardly through the mixing cylinder 8 to the water outlet pipe 32. When passing through the mixing cylinder 8, the water and ozone mixture is cut by the spiral mixing blade 80, and evenly mixed again. On the contrary, when the electromagnetic valve 42 is turned off, the ball valve 75 is pushed back by the spring 74 to stop the center hole 761 of the gasket ring 76 again.

I claim:

1. A urinal flushing control device comprising:

a casing covered with a front cover, said front cover having a glass window;

a water intake pipe fixedly mounted inside said casing, having a bottom end adapted to be connected to a water supply source, and a top end;

a water outlet pipe having a top end connected to said water intake pipe, and a bottom end adapted to be connected to a discharge pipe of a urinal;

a connector mounted inside said casing, having a top end connected to said water intake pipe through a connecting pipe, and a bottom end connected to the top end of said water outlet pipe;

an electromagnetic valve connected to said connector, and controlled to close/open the passage between said connector and said water outlet pipe;

an ozonizer mounted in said casing and controlled to generate ozone, permitting it to be mixed with water passing from said connector to said water outlet pipe, said ozonizer comprised of an ozone generating device in which oxygen is coverted into ozone, a high voltage generator controlled to discharge a high voltage to said ozone generating device for converting oxygen into ozone, and an air pump controlled to pump air into said ozone generating device, said ozone generating device having an output end connected with an ozone supply pipe;

a photoelectric sensor mounted inside said casing behind said glass window to detect the presence of a person, and to control the operation of said electromagnetic valve when it detects a signal; and a timer mounted on said casing on the outside thereof and set to control the discharge of ozone from said ozonizer;

wherein a three-way pipe and a mixing cylinder are connected in series between said connector and said water outlet pipe, said three-way pipe comprising a first pipe section connected to said connector, a second pipe section longitudinally extended from said first pipe section and connected to said mixing cylinder, a third pipe section perpendicularly extended from the connecting area between said first pipe section and said second pipe section and connected to said ozone supply pipe, and a spring-supported ball valve means mounted in said third pipe section to control the passage between said third pipe section and said ozone supply pipe, said first pipe section defining a tapered water passage gradually reducing toward said second pipe section, said second pipe section defining a tapered water passage gradually increasing from said first pipe section toward said mixing cylinder, said third pipe section defining a longitudinal air passage, and a jet at one end of said longitudinal air passage in communication with the tapered water passages of said first pipe section and said second pipe section, said spring-supported ball valve means being forced by spring means thereof to close the passage between said third pipe section and said ozone supply pipe when said electromagnetic valve is closed and water is stopped from passing through said connector to said water outlet pipe, said spring-supported ball valve means being driven by a vacuum suction force to open the passage between said third pipe section and said ozone supply pipe for permitting ozone to flow from said ozonizer into said three-way pipe for mixing with water passing by when said electromagnetic valve is opened to let water be discharged from said connector through said three-way pipe and said mixing cylinder to said water outlet pipe said mixing cylinder having a top end connected to the second pipe section of said three-way pipe, and a bottom end connected to said water outlet pipe, and further having a spiral mixing blade interiorly thereof for thoroughly mixing the water and ozone.

* * * * *